United States Patent [19]

Boatsman

[11] Patent Number: 5,065,558

[45] Date of Patent: Nov. 19, 1991

[54] PREFABRICATED MODULAR BUILDING CONSTRUCTION SYSTEM

[75] Inventor: W. Harley Boatsman, Portland, Oreg.

[73] Assignee: Gibraltar World International, Ltd., Portland, Oreg.

[21] Appl. No.: 456,315

[22] Filed: Dec. 26, 1989

Related U.S. Application Data

[63] Continuation-in-part of Ser. No. 299,629, Jan. 23, 1989, abandoned.

[51] Int. Cl.[5] ..... E04B 2/78; E04B 2/38

[52] U.S. Cl. ..... 52/239; 52/583; 52/585; 52/726; 52/281; 52/601

[58] Field of Search ..... 52/281, 282, 238.1, 52/239, 240, 241, 243.1, 726, 585, 586, 301, 583, 281, 601

[56] References Cited

U.S. PATENT DOCUMENTS

| | | | |
|---|---|---|---|
| 1,394,550 | 10/1921 | Herbrick | 52/587 |
| 2,091,061 | 8/1937 | Waugh | 52/263 |
| 2,238,355 | 4/1941 | Whitenack | 52/656 |
| 3,228,161 | 1/1966 | McCown | 52/285 |
| 3,282,006 | 11/1966 | Halsey et al. | 52/301 |
| 3,513,606 | 5/1970 | Jones | 52/239 |
| 3,600,864 | 8/1971 | Godley et al. | 52/495 |
| 3,733,757 | 5/1973 | Scott | 52/105 |
| 3,877,191 | 4/1975 | Munsey | 52/239 |
| 3,996,714 | 12/1976 | Hazelett | 52/583 |
| 4,009,550 | 3/1977 | Young | 52/726 |
| 4,126,978 | 11/1978 | Heller | 52/461 |
| 4,594,829 | 6/1986 | Herrgord | 52/285 |
| 4,606,165 | 8/1986 | Allan | 52/583 |

FOREIGN PATENT DOCUMENTS

| | | | |
|---|---|---|---|
| 630391 | 7/1964 | Canada | 52/301 |
| 935454 | 11/1955 | Fed. Rep. of Germany | 52/781 |
| 3141201 | 4/1983 | Fed. Rep. of Germany | 52/474 |
| 2471461 | 6/1981 | France | 52/726 |
| 2526918 | 11/1983 | France | 211/183 |
| 887757 | 12/1981 | U.S.S.R. | 52/474 |
| 10840 | of 1906 | United Kingdom | 52/780 |

*Primary Examiner*—James L. Ridgill, Jr.

*Attorney, Agent, or Firm*—Chernoff, Vilhauer, McClung & Stenzel

[57] ABSTRACT

Reinforced concrete wall components have top, bottom and side margins of a V-shape, and these margins have cooperative engagement with matching horizontal and vertical frame portions to provide a laterally stable support and connection between the wall components and frame portions. Eyes anchored in the concrete are spaced along the margins of wall components for use in lifting the wall components and for interconnecting them to horizontal and vertical frame components. Connection between the horizontal and vertical frame portions and to footings also comprises anchor projections and cooperating box-like connectors which receive the projections. Various arrangements of anchor projections are provided for connecting adjoining walls of a building.

18 Claims, 8 Drawing Sheets

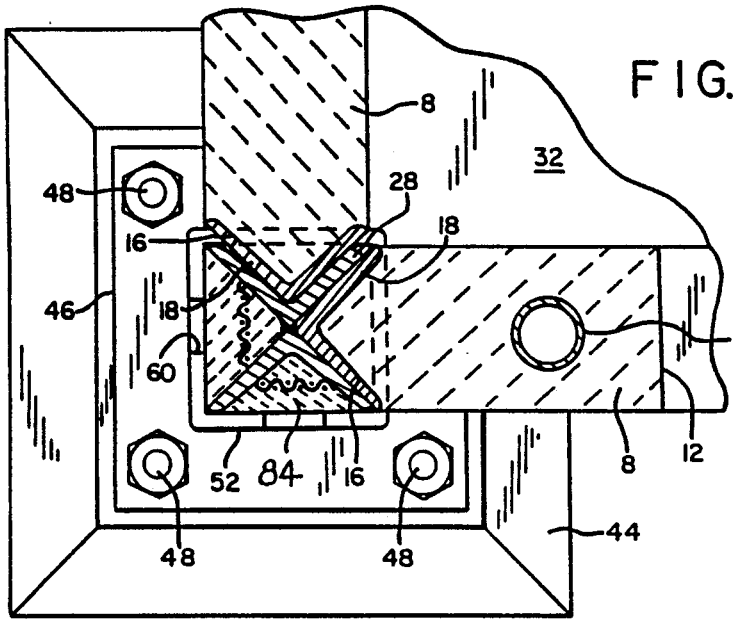
FIG. 2
FIG. 7
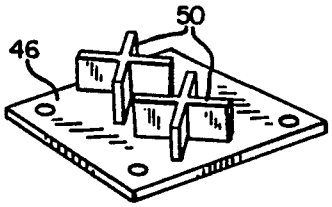
FIG. 3
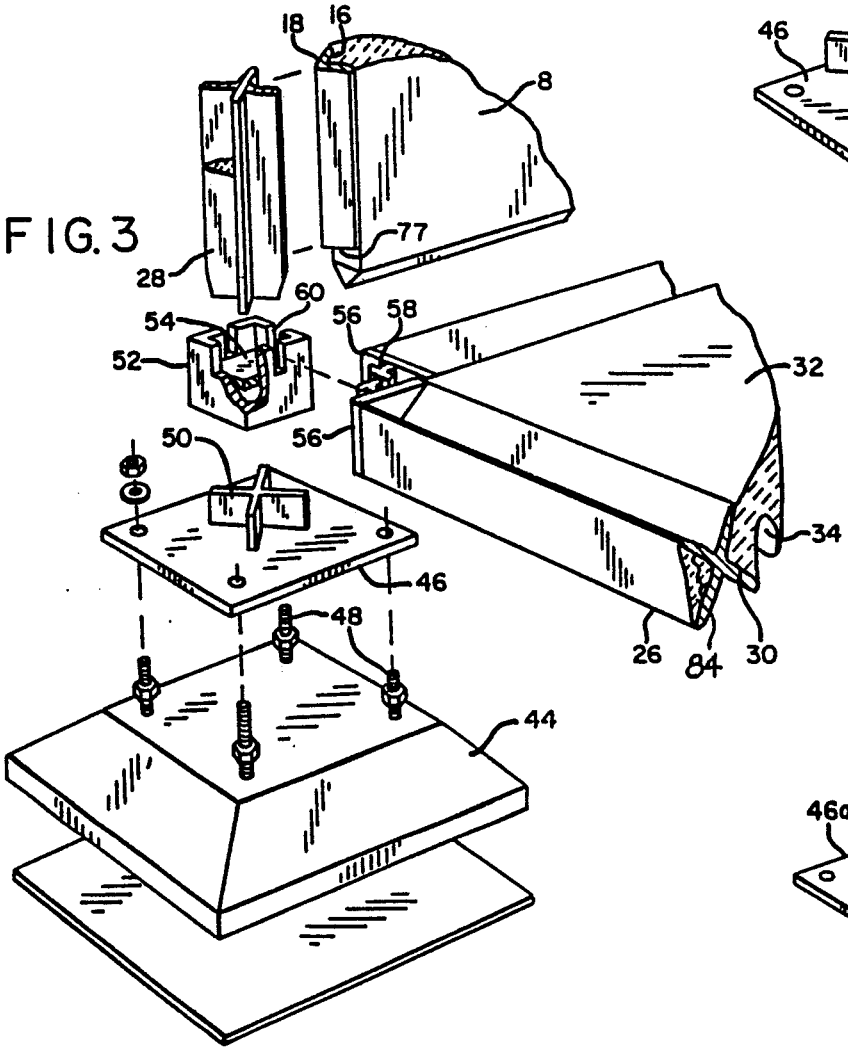
FIG. 8
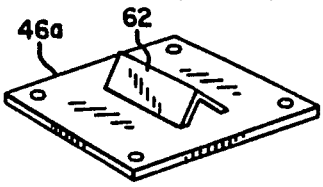

PREFABRICATED MODULAR BUILDING CONSTRUCTION SYSTEM

This is a continuation-in-part of pending U.S. patent application Ser. No. 07/299,629, filed Jan. 23, 1989, now abandoned.

BACKGROUND OF THE INVENTION

This invention relates to building construction and is particularly concerned with construction of buildings of reliable strength incorporating factory-produced reinforced concrete modular components.

Building construction systems which utilize precast concrete structural components have found widespread acceptance, partly because of their capacity for use in construction of relatively low-cost, strong and durable buildings. Many different types of prefabricated building parts and connectors have been proposed for interconnection in the process of erection of footings, floors, walls and ceilings buildings of a variety of uses.

Such prior art patents as Russian Patent 887,757, Hazelett, Jr. U.S. Pat. No. 3,996,714, Allan U.S. Pat. No. 4,606,165, Herbrick U.S. Pat. No. 1,394,550, Cox U.S. Pat. No. 3,898,776, and Waugh U.S. Pat. No. 2,091,061 describe various concrete panel structures and ways in which they can be interconnected as parts of buildings. Scott U.S. Pat. No. 3,733,757 discloses a building frame structure in which concrete members are interconnected by mechanical connectors.

Heller U.S. Pat. No. 4,126,978 and Herrgord U.S. Pat. No. 4,594,829 disclose systems for interconnecting the edges of panels for use, for example, as space dividers.

German Patent No. 935,454 discloses a building having small wall panels with tapered margins, interconnected by and held in place between vertical members by grooves defined by the vertical members to receive the tapered margins of the panels.

British Patent No. 10,840 discloses a prefabricated wooden structure utilizing columns defining vertical grooves for receiving the ends of wall panels. Footings include square sockets to receive the lower ends of such columns.

The prior art refers to the need for such construction processes as welding of connecting parts at the building site, where a certain level of skill is required of the technician to produce satisfactory welds without creating additional stress or deformation of the various parts. Skill among welders is known to vary greatly and quality control inspection as done on-site is at best spotty, sometimes impractical, and at other times virtually impossible. Therefore it is desirable to do as much as possible of such structural welding in a controlled factory environment, and then to fasten structurally related parts to one another mechanically at the building site. Factory quality-control supervision is also desirable to avoid the results of corrupt failure to enforce building codes.

One previously known practice employed to assemble and hold together precast concrete panels is the use of bolted-on steel tie plates, connecting vertical panels at their corners. Under stress of severe natural forces, however, such corner areas tend to shear off causing walls to collapse.

It is desirable, therefore, to be able to quickly erect a relatively low-cost building shell which is strong and durable, using prefabricated concrete panels which can be transported to the construction site. It is desirable for such a building to be able to be disassembled and reerected at a different location.

It is also very important that the structure erected of such components be able to withstand the various stresses to which it might be subjected, including those such as storm winds or earthquakes.

What is needed, then, is a building system for manufacturing low-cost buildings of predictable quality which can be rapidly assembled, and which, once assembled, are rigidly and securely unified into a structure capable of successfully resisting such extraordinary forces as those of storm winds and earthquakes as well as normal building loads.

SUMMARY OF THE INVENTION

The present invention provides a building construction system that offers low-cost quality-controlled factory production and very short building erection time, and will result in a building structure having rugged integral strength to avoid collapse from earth movements or resonant vibration of the structure resulting from naturally-occurring extraordinary phenomena such as earthquakes or severe storms.

The present invention provides a system for constructing buildings of concrete panels interconnected by structural metal elements. Some of the structural metal elements are integrated with and form parts of the concrete panels of the building structure of the present invention, so that the panels can be interconnected with others easily to form a rigid structure, with a minimum of welding on the construction site being necessary. In accordance with the invention the concrete panels are interconnected primarily by interlocking fit between the various members, and secondarily by the use of simple mechanical fasteners.

Thus, in one embodiment of the invention horizontal reinforced concrete floor-ceiling panels incorporate frames of "X" cross-sectional shape, with the margins of the floor received in laterally-open, horizontal V-shaped channel and upwardly and downwardly-open V-shaped channels being defined to receive the top and bottom margins of vertical wall panels. The wall panels define projecting V-shaped margins which are reinforced by metal angle stock which is received in the V-shaped channels to interconnect the horizontal and vertical panels, while the vertical margins of the vertical wall panels are received in V-shaped grooves of vertical column members. Corner connectors attached to the horizontal panels receive the ends of the column members.

An important feature of structures able to survive the forces generated by earthquakes, such as buildings of precast concrete modules, is the firm interconnection of load-bearing wall panels that support the structure with each other and with the floors and ceilings. It is important for such a building to transmit forces to which it is subjected directly downward through the structure to its foundations.

Buildings designed to withstand earthquakes are intended primarily to be erected on firm foundations which incorporate suitable movable elements and damping, as required, to prevent harmonic or sympathetic movement of the building.

In the manufacture of precast concrete building panels, lifting eyes or other attachments are typically specifically placed and so embedded therein as to offer cable access tie points for attachment to cranes, to hoist and place such parts into their respective positions during erection of a building.

In accordance with the present invention such eyes or similar devices are located within the V-shaped margins of wall panels, and are useful not only for lifting the wall panels, but also as tie points so as to connect all parts of a building to each other, with sturdy plates and bolts firmly securing wall panels respectively to other walls and to floor and ceiling modules, through the frame members included as integral parts of floor and ceiling modules, and through the column members which extend between floor and ceiling members. Wall panels so secured on all sides become integrated parts of the support structure of the building, offering virtually immovable rigidity, and are capable of withstanding natural forces from any direction.

It is therefore a principal object of the present invention to provide an improved prefabricated building utilizing concrete panel construction and having load-bearing walls firmly interconnected with floors, ceilings, and adjoining walls.

It is another important object of the present invention to provide such a building construction which provides for rapid erection of a building using prefabricated structural elements which can be assembled on site with a minimum of technical skill.

It is a principal feature of a building constructed according to the present invention that walls and floors are interconnected with one another along the margins of concrete panels which are received within channels or V-shaped grooves defined by horizontal structural metal members which form parts of a surrounding frame of floor panels, and vertical column members which act to interconnect adjacent or intersecting wall panels.

It is another important feature of the present invention that it provides for interconnection of vertical wall panels, horizontal floor modules, and vertical column members at corner connectors which form a part of each of the horizontal floor modules.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 2 is an enlarged fragmentary horizontal sectional view taken on the line 2—2 of FIG. 1.

FIG. 3 is an exploded view showing a footing support for the present invention and also showing corner connector means.

FIG. 7 is a perspective view of another arrangement of anchor means.

FIG. 8 is a perspective view of lateral stabilizing means used at intermediate footings.

DETAILED DESCRIPTION OF PREFERRED EMBODIMENTS

Figure 1:
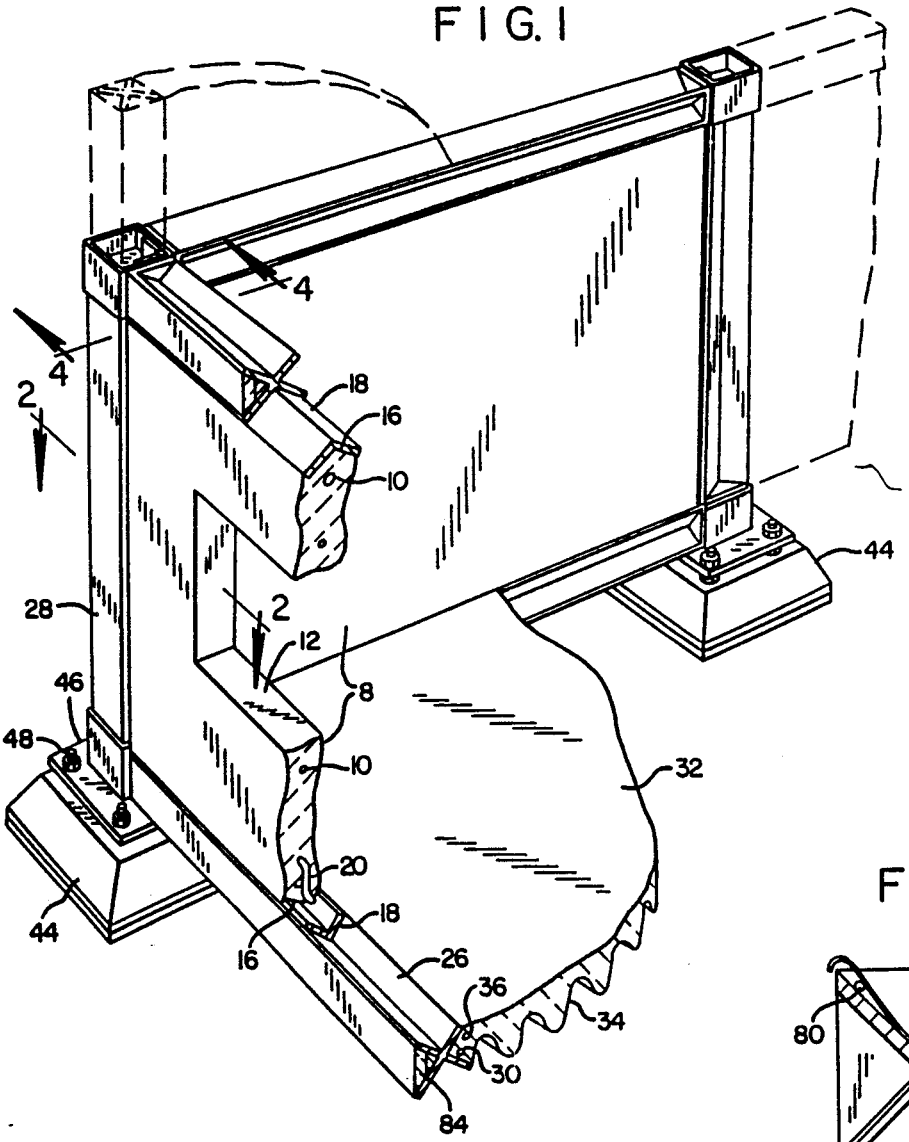
FIG. 1 is a fragmentary perspective view of a prefabricated building construction employing principles of the present invention.
Figure 4:
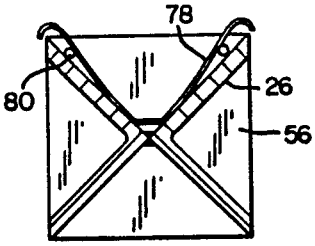
FIG. 4 is a cross-sectional view of an X-shaped frame member which forms a part of the present building.

With particular reference to the drawings, and first to FIGS. 1, 2 and 3, a prefabricated building embodying the present invention comprises wall components or panels 8 of rectangular shape and dimensioned selectively for ease of factory construction, transportation to the building site, and assembly. Each of the wall components 8 comprises concrete or the like and can be poured or otherwise formed on a suitable table in the factory. In such construction, the wall components have reinforcing rebar 10 or the like and may include openings 12 for windows, doorways, and the like. These wall components 8 are poured with suitable utilities or utility access conduits 14 included therein in a well-known manner.

In the formation of the wall components 8, the top, bottom and end margins 16 are V-shaped, preferably having a convex wedge-like taper to form a right-angle V surface. These tapered surfaces are preferably covered by angle iron members 18 for reinforcement. Angle iron members 18 can be secured to the wall components as by factory-welded embedded devices 20 extending into the concrete, and are welded together at the corners to form a rigid frame.

Although the frame members 18 are not a necessary part of the wall components, such members are preferred since they reinforce the wall components and protect the margins 16 as well. Furthermore, in prefabrication, these frame members can be used as the mold outline for pouring the wall panels 8. Also, after the walls have set, they assist in handling the completed wall components for removing it from the pouring table and for transporting it to the building site.

Wall components 8 are associated with horizontal X-shaped frame members or portions 26 and vertical X-shaped frame members 28, FIGS. 1–4. Such X-shaped frame members 26 and 28 may comprise pairs of conventional angle irons welded together at their peaks, or alternatively they may be rolled or extruded. Placing portions of the V-shaped margins 16 or of frame members 18 within the recess portions of the X-shaped frame portions 26 provides an interfitting engagement having lateral stability.

The X-shaped frame portions 26 provide four channels 29 therearound for receiving the top and bottom margins of wall components 8 as well as V-shaped margins 30 of reinforced concrete floor/ceiling panels 32. The body portion of floor/ceiling panels 32 includes a conventional waffle-type structure 34 o the like. Such floor/ceiling panels preferably include reinforcements such as rebar 36.

Upright frame members 28 are associated with footings 44. Such footings are of conventional construction whereby to support a bearing plate 46 for leveling adjustment by studs 48. According to the invention, and with reference to the structure shown in FIGS. 1–4 and 6, an X-shaped anchor projection 50 is integral with the bearing plates and is arranged to receive a box-like open-ended connector 52 thereon in snugly surrounding engagement. Connectors 52 include an intermediate horizontal partition 54. Anchor projections 50 can comprise the same cross sectional structure as the frame members 26 and 28, namely, two angle irons secured together at their peaks or rolled or extruded stock cut to a short length. For the vertical connection of the vertical frame members 28 with the footings, such frame members telescope a short distance down in the connectors 52 for seating abutment against partition 54. Thus, the connectors 56 have telescoping relation with both the vertical frame members 28 and the anchor projections 50. Such parts may be welded for permanent installations or merely fitted together for later disassembly in the event that the building is temporary.

Figure 5:
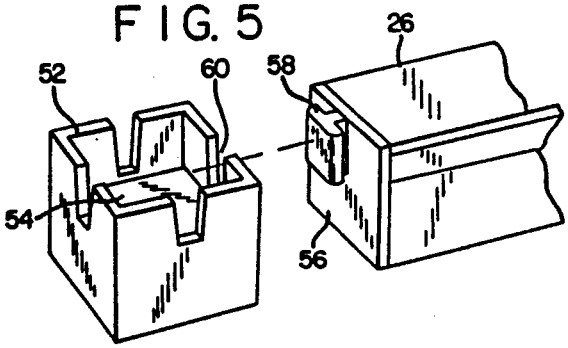
FIG. 5 is an exploded perspective view illustrating connection of one of the X-shaped frame members to a corner connectors.
Figure 6:
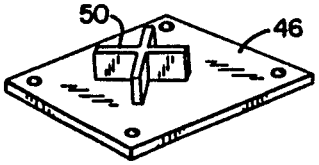
FIG. 6 is a perspective view showing a first arrangement of anchor means used with the footings.

Horizontal frame members 26 have integral end plates 56, FIGS. 3 and 5, each with a T-shaped wedge projection 58 thereon. Connectors 52 are provided with tapered side slots 60 open at the top and arranged for interlocking engagement with the tapered T-shaped projections 58. The wedging relation between wedge projections 58 and slots 60 comprises a non-releasing taper for secured engagement once they are forced together.

Figure 9:
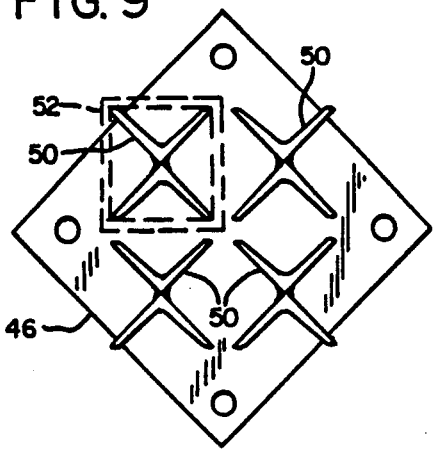
FIG. 9 is a top plan view of anchor means utilized at corners.

FIGS. 7 and 9 show other arrangements of the anchor projections 50 on the anchor plates 46. For example, the structure of FIG. 7 illustrates an anchor projection arrangement wherein a pair of vertical frame members 28 are to be located in adjacent position for the purpose of providing adjoining wall components in alignment or at a corner, and FIG. 9 shows four of the anchor projections arranged in a square for securing four adjacent vertical frame portions in other wall arrangements. FIG. 8 illustrates a bearing/weld plate **46*a* having an inverted V-shaped projection 62 arranged to fit up into a bottom V-shaped recess of a horizontal frame members 26. Base plates 46*a* and their projections 62 are arranged to provide additional footing support for wall panels at points between main footings 44**.

Figure 10:
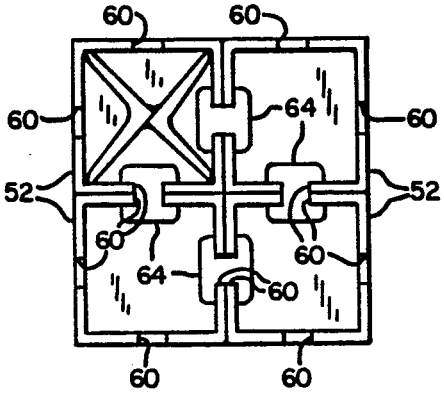
FIG. 10 is a plan view similar to FIG. 9 and showing connection of a frame member with corner connectors.
Figure 11:
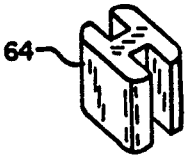
FIG. 11 is a perspective view of a fastener for securing adjacent connectors together.

FIGS. 10 and 11 illustrate the use of separate tapered T-shaped fasteners 64 arranged to be fitted into the tapered slots 60 of adjoining box-like connectors 52 for holding these connectors together at a corner. Fasteners 64 and slots 60 have a non-release taper fit. Connectors 52 may have slots 60 on as many sides thereof as required.

FIGS. 10 and 11 illustrate the use of separate tapered T-shaped fasteners 64 arranged to be fitted into the tapered slots 60 of adjoining box-like connectors 52 for holding these connectors together at a corner. Fasteners 64 and slots 60 have a non-release taper fit. Connectors 52 may have slots 60 on as many sides thereof as required.

Figure 12:
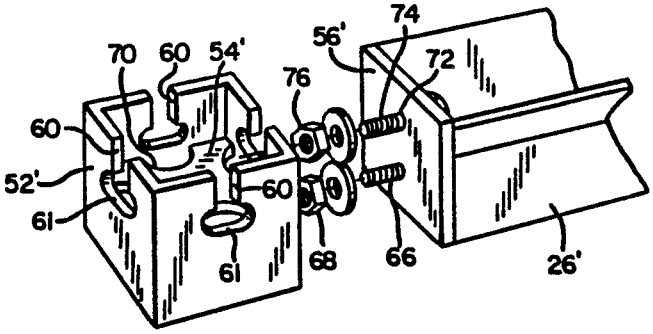
FIG. 12 is a perspective blown up detail view showing the manner of fastening a connector to a horizontal frame member.
Figure 13:
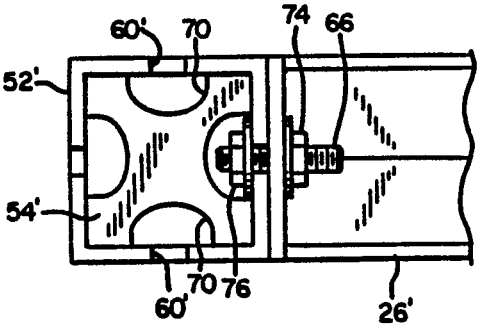
FIG. 13 is top view of the portion of a horizontal frame member and connector shown in FIG. 12.

FIGS. 12 and 13 illustrate a further embodiment of connector 52' and X-shaped frame member 26'. Connector 52' is similar to the connector 52 of FIG. 5, having an intermediate horizontal partition 54' for seated engagement by a vertical frame member 28. Connectors 52' also have top opening slots 60'. Slots 60' have bottom horizontal enlarged slot portions 61. The horizontal frame members 26' in this embodiment have a first stud 66 welded to them in the bottom of the upwardly facing V which projects through the end wall 56' and is arranged to extend through a slot 60' in a connector 52' and receive a securing nut assembly 68. This nut assembly is aligned with and extends through enlarged slot portion 61, this enlarged slot portion providing lateral fitted adjustment of the parts 52' and 26'. The partition 54 in connector 52' has cut-out portions 70 in vertical alignment with the slots 60' to provide working room for a tool at the nut assembly 68.

End wall 56' may also have a bore 72 above the stud 66 for receiving a lock bolt 74 having a nut assembly 76 disposed interiorly of the connector 52' for adding to the clamping engagement between the parts 52' and 26'.

A building is assembled at the site by installing the footings 44 as shown, or continuous footings, in a suitable manner and then connecting the various elements together by means of the bearing plates 46 and their projections 50, the box-like connectors 52, and the horizontal frame portions 26, 26', and floor panels 32, vertical frame portions 28 and wall panels 8, and ceiling panels, not shown, similar to panels 32. The vertical V-shaped margins 16 and reinforcing members 18 of the wall panels 8 terminate short of the bottom of these panels as at 77 (FIG. 3) to allow clearance at these edges for the end walls 56 and connectors 52. The cut-away portion 77 also allows clearance over the stud 66 in the FIG. 12 embodiment. The building construction can include adjoining wall panels by using a double anchor projection arrangement as shown in FIG. 7. Corner constructions can be assembled using the anchor projection arrangement of FIG. 9 or FIG. 10, and multiple story arrangements are available by stacking the frame portions and wall components vertically as shown in broken lines in FIG. 1. Ceiling panels form the floor for multiple level arrangements. The outer surface of the building can be finished in a suitable and conventional manner. In addition, and with reference to FIG. 4, water seal means including a neoprene rubber liner 78 and seals 80 can be used in the V-joints.

The present invention has many advantages. Although the reinforcing frame members 18 need not be used, they have the advantage that they can be used, as stated hereinbefore, to comprise welded rectangular frames usable as the mold or form for pouring the walls. Welding of the members 18 into a frame can take place elsewhere in the factory and after such welding, the frames can be transferred to concrete pouring table for completion of the wall. A similar construction pattern can be accomplished for the floor panels 32 by using the defining horizontal frame portions 26, 26'. These steel frames provide good rigidity and other desired constructional features. The parts can be assembled without complicated fasteners. A filler material and surfacing 84 is applied to the recessed portion of the frame members 26 and 28. If a permanent type building is desired, welding can be accomplished at all meeting metal portions. Formation of the wall and floor panels is fast and inexpensive and thus contributes to economy of construction. The reinforcing members 18, if of angle iron rather than a special rolled shape or extrusion, are readily cut from conventional product, and thus are readily available. The frame portions 26, 26' and 28, 28' as well as the anchor projections 50 likewise can be formed of conventional angle irons welded together at their peaks. The configuration, upon assembly, affords strength to resist extraordinary forces such as those of earthquakes, etc.

Referring now to FIGS. 14–22, a prefabricated building structure which is another embodiment of the present invention includes a plurality of wall panel components 90, generally but not completely similar to the wall panel components 8. Each of the vertical wall panels 90 includes a surrounding frame 92 of metal such as angle iron stock defining projecting wedge-like top, bottom, and vertical end margins 94, 96 and 98 of the complete panels 90. As with the vertical wall panels 8 described previously, the surrounding frame 92 may be used to contain the concrete material 91 of which the panel is made while the concrete or the like is poured or otherwise formed on a suitable table in a factory.

In a building constructed in accordance with the invention vertical end marginal reinforcements 100, horizontal top marginal reinforcement members 102 and bottom horizontal marginal reinforcement members 104 extend along respective margins of the vertical wall panel 90, forming the surrounding frame 92, and are interconnected with one another at respective corners of the vertical wall panel 90. At a plurality of spaced-apart locations along each of the marginal reinforcement members, respective lifting eyes 106 are fastened to anchor structures 108, embedded in the concrete of the vertical wall panels 90 and are exposed through respective apertures 110, defined, respectively, in the marginal reinforcements 100, 102, and 104. Each of the lifting eyes 106 is exposed so that a central axis 112 of the opening defined by the respective eye 106 extends transversely with respect to the general plane of the vertical wall panel 90. Further, conventional anchoring devices 114 are preferably attached as by welding to each of the marginal reinforcements 100, 102, and 104 to fasten the reinforcements securely to the concrete of the vertical wall panel 90. Additionally, reinforcement material in the form of conventional rebar 116 and other reinforcement such as mesh 118 is preferably embedded in the concrete.

Preferably, the concrete 91 is of a lightweight composition, in order to reduce the costs of transportation of building components from the site of manufacture to the site of erection of the building.

At each of the corners of the vertical wall panels 90, the respective end marginal reinforcement member 100 extends upward or downward as an interlocking component 120 of the vertical wall panel 90. A gap or notch 122 is provided between the interlocking component 120 and the respective end of the adjacent top marginal reinforcement 102 or bottom marginal reinforcement 104. Preferably, small triangular dams 124 of metal are interposed as by being welded in place within the end marginal reinforcements 100 and top and bottom marginal reinforcements 102, 104 to retain the concrete 91 being poured during manufacture of the vertical wall panels 90 and to assist in interconnecting the respective marginal reinforcements. Similarly, plugs or dams may be provided around the lifting eyes 106 during pouring of the concrete 91 to prevent it from flowing into the apertures 110.

Horizontal frames 130 surround reinforced floor/-ceiling panel structures 132, and are fabricated of interconnected elongate horizontal frame members 134 of X-shaped cross section similar to the frame members 28 shown in FIGS. 1–4. The horizontal frame members 134 are interconnected with one another at respective corners through corner connectors 136. The ends of adjacent horizontal frame members 134 are welded to the respective sides of the corner connectors 136 which are generally square open-ended boxes of metal plate material of suitable strength, arranged to be upwardly and downwardly open with reference to the horizontal plane of the floor/ceiling member 132. The horizontal frame members 134 are arranged so that the X-shaped form of each horizontal frame member presents an upwardly open V-shaped channel 138 and an opposite downwardly-open V-shaped channel 140, while the concrete 131 of the floor/ceiling panel 132 is poured to engage with a laterally-open V-shaped channel 141.

Spaced apart along each of the horizontal frame members 134, at locations corresponding to the locations of individual lifting eyes 106 spaced apart along the vertical wall panels 90, are corresponding apertures 142 for receiving respective connector bolts 144.

Preferably, in pouring the concrete 131 of the floor/-ceiling panels 132, appropriate dams are utilized to provide an opening 146 providing access to the interior side of each horizontal frame member 134 aligned with each of the apertures 142.

The vertical wall panels 90 mate with the horizontal frame 130, with the respective top and bottom margins 94, 96, including the marginal reinforcements 102, 104, being received snugly within respective upwardly open channels 138 and downwardly open channels 140. A pair of connector bolts 144 are interconnected with one another by a tie plate 148 as shown best in FIG. 20. The pair of connector bolts 144 extend through the upper apertures 142 and lower apertures 143, and thence through the respective lifting eyes 106 of respective vertical wall panels 90 located both above and below the horizontal frame members 134. Interconnection utilizing the connector bolts 144 thus retains this mating relationship between the vertical wall panels 90 and the horizontal frame members 30 despite the influence of unusual forces such as those caused by earthquakes and severe storm winds or water waves.

Figure 14:
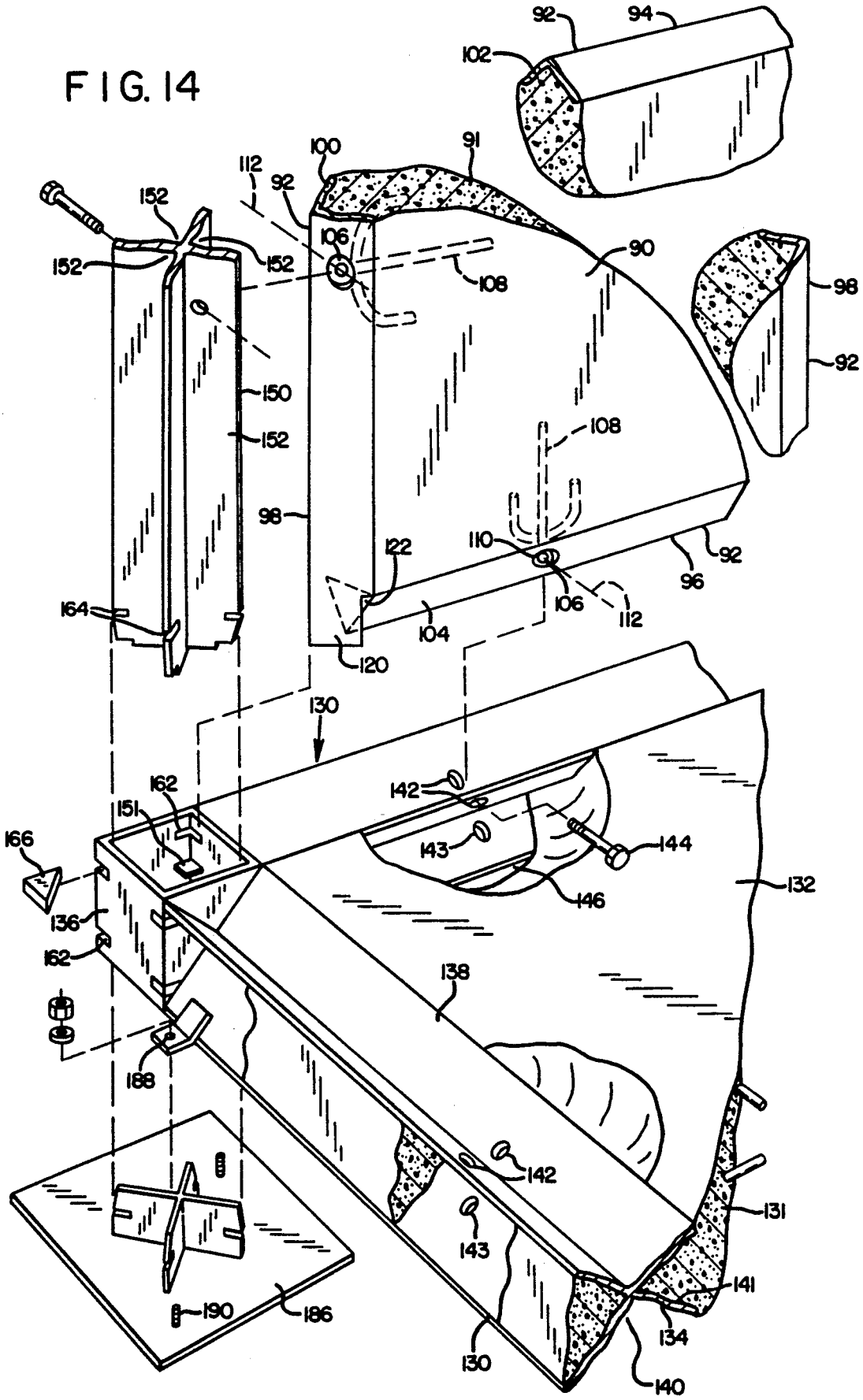
FIG. 14 is a fragmentary blown-up perspective view of a prefabricated building construction which is another embodiment of the present invention.
Figure 15:
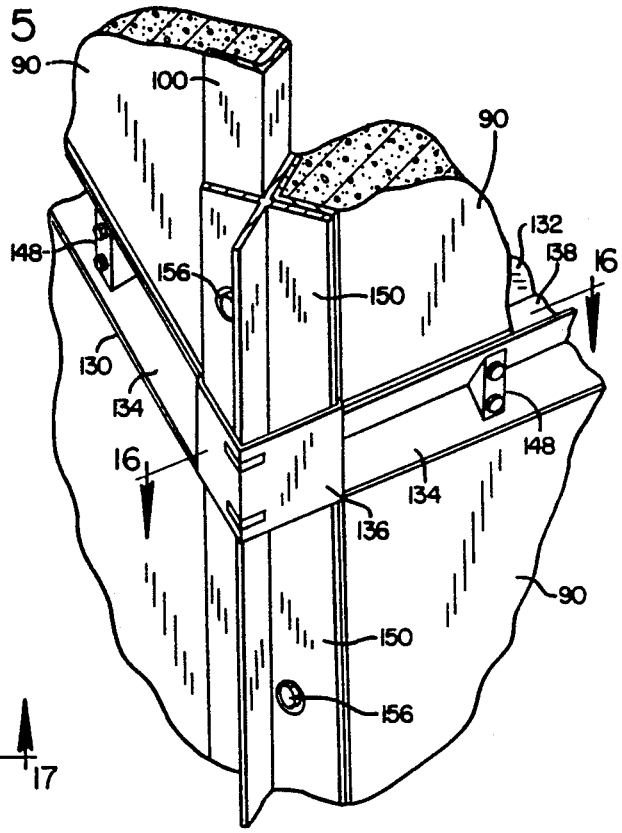
FIG. 15 is a perspective detail view showing the interconnection of a pair of vertically adjacent wall panels with an intermediate horizontal panel of the structure shown in FIG. 14.
Figure 16:
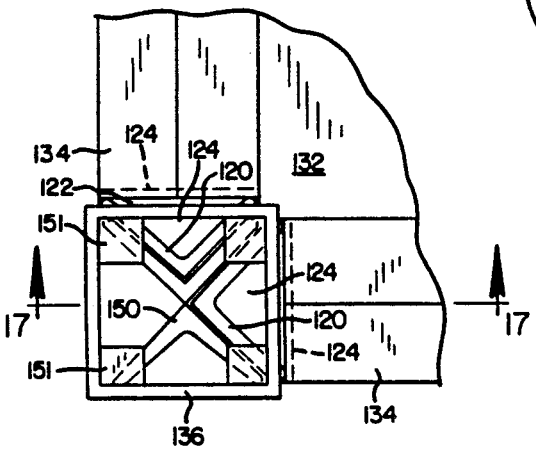
FIG. 16 is a sectional view taken along line 16—16, showing the interlocking connection of structural elements of the building structure shown in FIG. 15.
Figure 17:
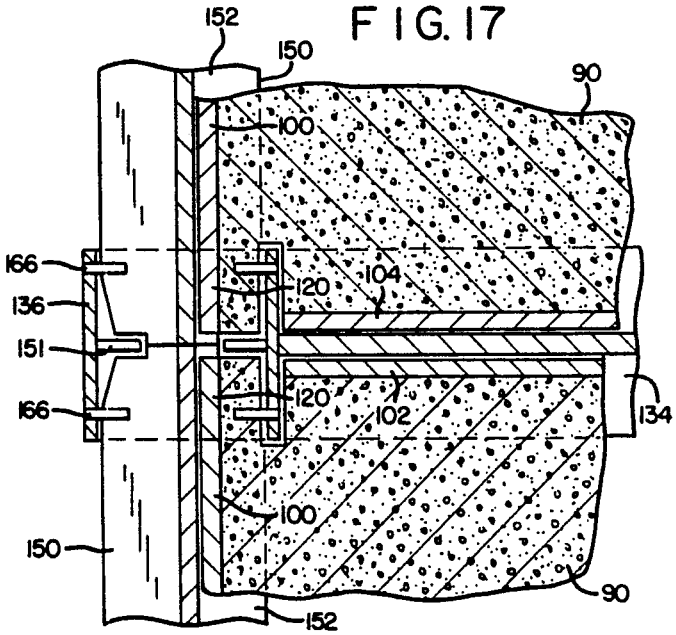
FIG. 17 is a sectional view, taken along line 17—17, of the interlocking interconnection of structural elements shown in FIG. 16.
Figure 18:
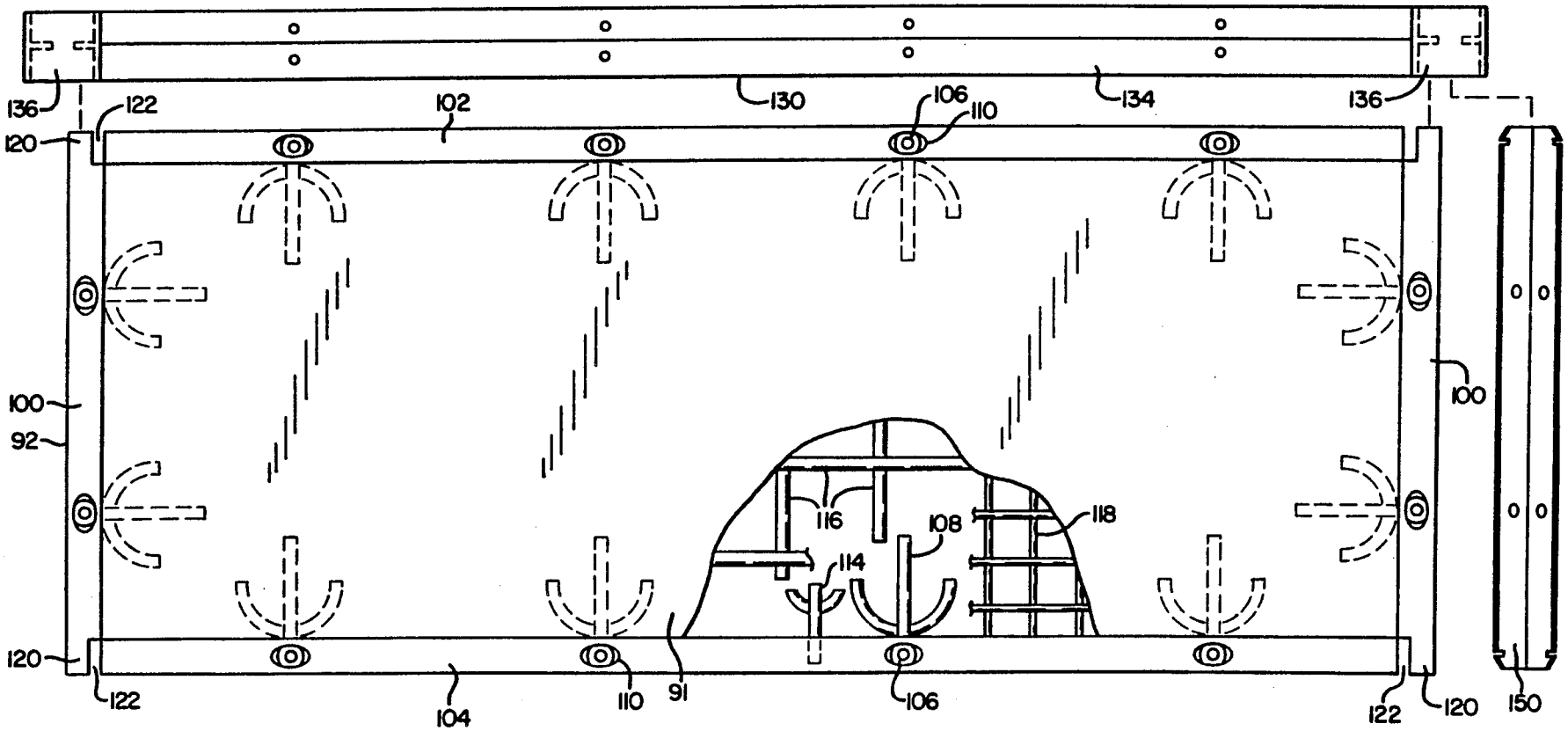
FIG. 18 is a partially cut away view of a wall panel showing the arrangement of reinforcement of the concrete and of the embedded lifting eyes useful for interconnecting the wall panels with the horizontal panels of the building construction according the present invention.
Figure 19:
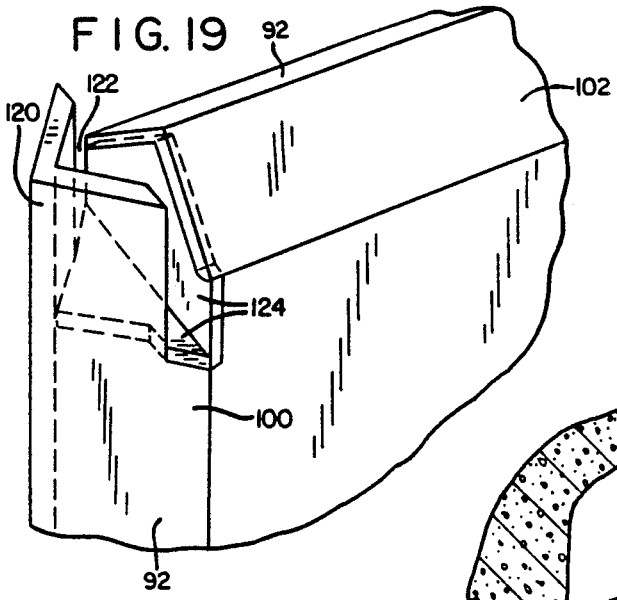
FIG. 19 is a perspective view showing an interlocking corner portion of a vertical wall panel of the building structure shown in FIG. 14.
Figure 20:
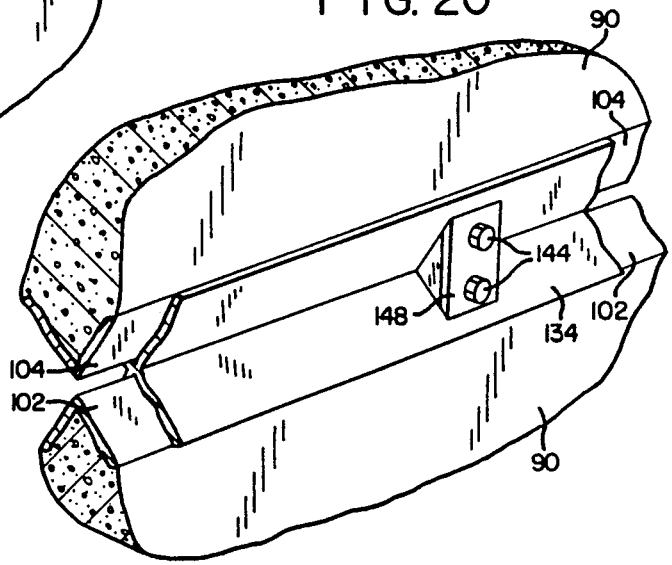
FIG. 20 is a partially cut away view of another portion of the wall-floor joint shown in FIG. 15.

Extending vertically with respect to the horizontal frames 130 are respective upright column members 150 of X-shaped cross section corresponding to the vertical frame members 28 shown in FIGS. 1–4. Each upright column member 150 has respective upper and lower ends which may be tapered slightly, in order to fit snugly within the interior of respective ones of the corner connectors 136, with the arms of the "X" shape extending diagonally of the square interior of the respective corner connector 136. Upwardly adjacent ones of the upright column members 150 are aligned with one another end-to-end, and are at least nearly in abutment with each other, the upright column members 150 being of an appropriate length to correspond with the accumulated height of the vertical wall panel 90 and the vertical separation maintained between upwardly adjacent ones of the vertical panels 90 by the horizontal frames 130. Horizontal locators 151 may also be provided within the corners of the corner connectors 136, as shown in FIGS. 14, 16 and 17 with appropriate relief being provided in the ends of the vertical members 150, to provide additional strengthening of the corner angles within the corner connectors 136.

The upright column members 150, by their X-shaped cross-section, define laterally open vertically-extending V-shaped grooves 152. The vertical end marginal reinforcement 100 of each vertical wall panel 90 fits snugly within a respective one of the laterally open grooves, mating snugly against the surfaces of the upright column member 150 which define the laterally open groove 152. The interlocking component 120 also extends also within the interior of the corner connector 136.

Connector bolts 156 extend through respective apertures 158 located in the upright column members 150 at locations corresponding to the respective lifting eyes 106 located on .the vertical end margins 98 of the vertical wall panels 90 to interconnect the vertical wall panels 90 with the adjacent upright column members 150 at each end of each vertical wall panel 90. This interconnection further integrates the building structure of this embodiment of the invention.

Additionally, keying apertures such as slots 162 may be defined in appropriate locations such as the corners of the corner connector 136. Slots 164 may be defined in the respective flanges of the upright column member 150 at locations to correspond with the locations of the slots 162 when the upright column members 150 are properly located within the corner connectors 136, and a locking key, which may be a small plate 166, may be inserted through the slot 162 into the bore 164 to interconnect the upright column member 150 with a respective corner connector 136.

Outwardly exposed V-shaped channels defined by the horizontal frame members 134 or upright column members 150 may be filled and sealing materials may be used to prevent entry of water into the respective joints formed by mating interconnection of the vertical wall panels 90, horizontal floor/ceiling members 132, and upright column members 150 during construction of a building according to this embodiment of the invention, as is shown in FIG. 14.

Figure 21:
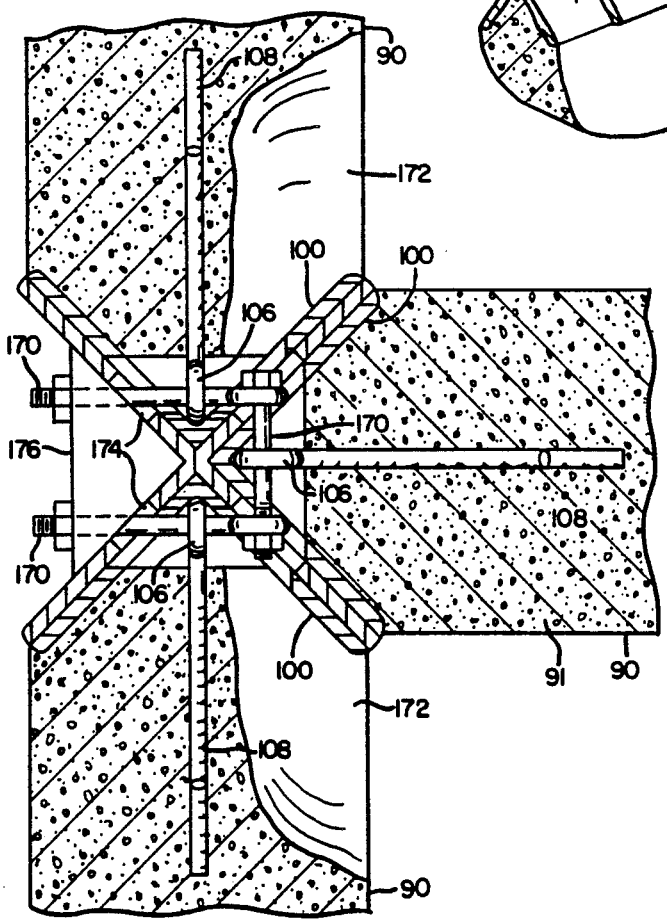
FIG. 21 is a sectional view showing one manner for interconnecting three orthogonal vertical wall panels.

As is shown in FIG. 21, three vertical wall panels 90 can meet at a particular corner to be interconnected through respective corner connectors 136 and to be interconnected with one another and with the respective upright column member 150 to form an integrated connection among the intersecting vertical wall panels 90 by the use of interlocking eyebolts 170, accessible by way of access openings 172 provided.

Figure 22:
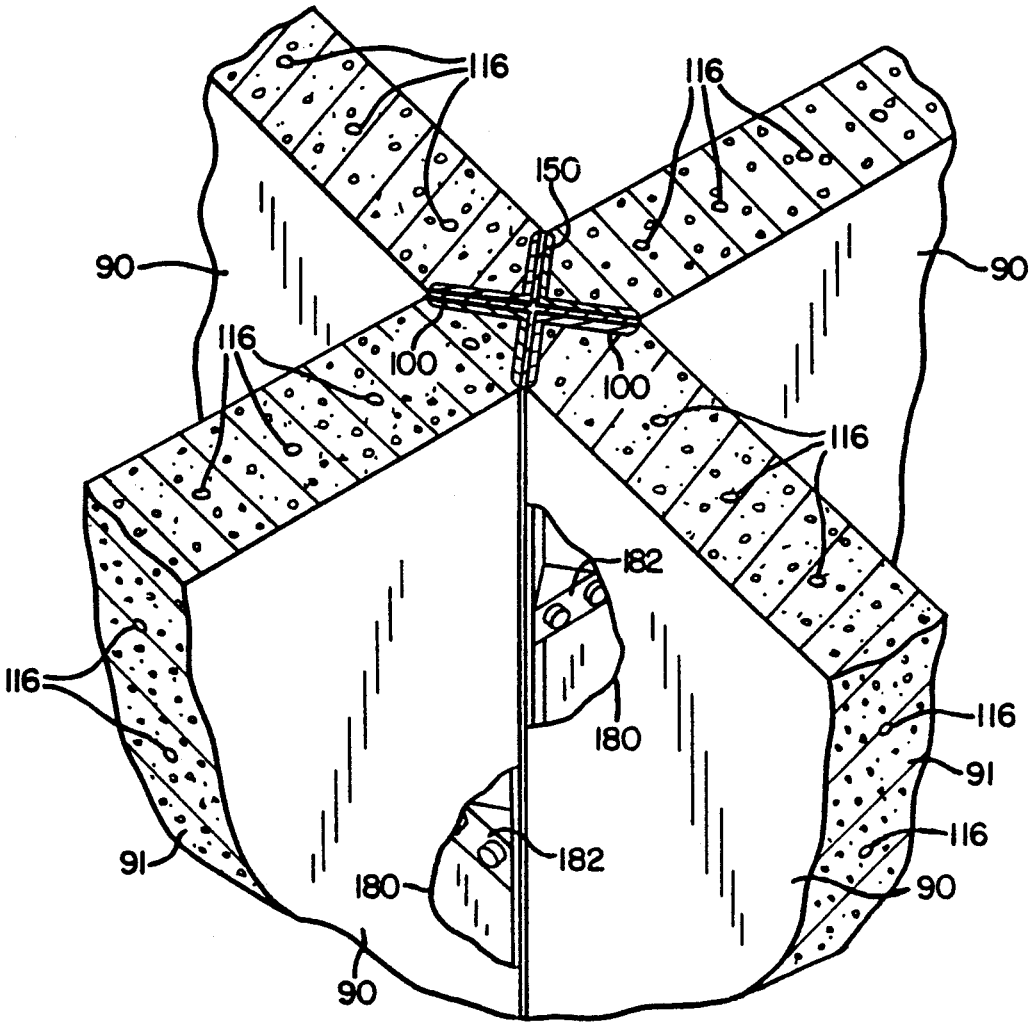
FIG. 22 is a fragmentary perspective view of the interconnection of four orthogonal vertical wall panels according to the invention.
Figure 23:
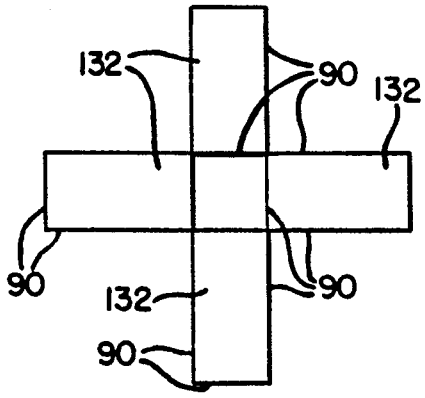
FIG. 23 is a plan view of a building plan including four interconnected modular buildings according to the present invention.

As shown in FIG. 22, four converging vertical wall panels 90 can also be fastened to one of the vertical column members 150 by providing separate interconnections similar to those shown in FIG. 21 at alternating locations along the intersection of the wall panels 90, with access openings 180 being provided to give access to bearing blocks 182, which are similar to the bearing blocks 176 except for being of an appropriate size and shape to fit within the respective vertical marginal end reinforcement member 100 of the respective wall panel including a respective access opening 180. Utilizing such interconnection among adjacent vertical wall panels 90, a four-wing star-shaped building plan may be utilized as illustrated in plan view in FIG. 23.

A building of the structure defined above may be erected upon footings 186, similar to footing 46. Hold-down brackets 188 (FIG. 14) may be used to fasten the horizontal frame 130 to the footings 186 through bolts 190, or corner connector 136 can be welded to footing 186. In the case of a building of such structure whose size and geographic location so dictates, the building may be constructed upon footings which are adapted to modify the transmission of forces generated by movement of the earth. Such earthquake-resistant footings are known and do not form a portion of the present invention, which provides a building structure of great integrity and stiffness which is intended to survive the application of such forces as those generated by earthquakes, severe storms, and water waves.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A prefabricated building structure, comprising:

(a) a plurality of upright column members each defining a laterally open V-shaped groove extending vertically therealong;

(b) a horizontal frame assembly including a plurality of horizontal frame members, each respectively defining an upwardly-open V-shaped channel and a downwardly-open V-shaped channel, the horizontal frame assembly further including a plurality of corner connectors, interconnecting adjacent ones of said horizontal frame members with one another, and interconnecting vertically adjacent ones of said upright column members with each other, each corner connector having four upright walls, respective ones of said walls being attached to a plurality of said horizontal frame members and said corner connectors being open upwardly and downwardly, and respective ends of said upright column members extending into and being held in respective ones of said corner connectors; and a plurality of vertical wall panels of concrete each having respective top, bottom, and end margins, at least one of said end margins being of protruding wedge-like V form corresponding to the shape of a respective one of said V-shaped groove and at least one of said top and bottom margins being of protruding wedge-like V form corresponding to the shape of a respective one of said V-shaped channels, each of said end margins being matingly received in a respective one of said laterally open V-shaped grooves, and at least one of said top and bottom margins being matingly received in one of said open V-shaped channels of said horizontal frame assembly.

2. The building structure of claim 1, each of said wall panels further comprising a locking member, each said locking member being matingly engaged in a respective one of said laterally open V-shaped grooves and located within a respective one of said corner connectors.

3. The prefabricated building structure of claim 1 wherein said upright column members are of X-shaped cross section and said corner connectors are open-ended boxes of generally rectangular shape and large enough to receive a respective end of a respective one of said upright column members snugly therein.

4. The prefabricated building structure of claim 1, each said horizontal frame member defining a laterally-open V-shaped channel, and said structure including a floor panel having margins of protruding wedge-like V form engaged in respective ones of said laterally open V-shaped channels.

5. The prefabricated building structure of claim 1 wherein a plurality of said horizontal frame members define laterally-open V-shaped channels, the structure further including a horizontal floor panel having respective margins of protruding wedge-like V form matingly engaged in respective ones of said laterally-open V-shaped channels.

6. The prefabricated building structure of claim 1 including connector means located on an end margin of one of said wall panels and on a respective one of said upright column members for interconnecting said wall panel with said respective one of said upright column members.

7. The prefabricated building structure of claim 6 wherein said connector means includes a pair of connector bolts and a tie plate holding said connector bolts parallel with each other spaced apart from each other by a predetermined distance.

8. The prefabricated building structure of claim 1 wherein each of said wall panels includes respective marginal reinforcement members extending along each of said top, bottom and end margins, said marginal reinforcement members defining said wedge-like V form of said margins, and being interconnected with one another to define respective corners of said wall panels.

9. The prefabricated building structure of claim 8 wherein each of said wall panels includes metal concrete-reinforcement members interconnected with said marginal reinforcement members.

10. The prefabricated building structure of claim 1, including key means for interconnecting a respective end of one of said upright column members with a respective one of said corner connectors so as to prevent removal of said end of said upright column member from said corner connector.

11. The prefabricated building structure of claim 10 wherein said key means includes a key and respective aperture means defined by said upright column member and by said corner connector for receiving said key when said upright column member is in a predetermined location with respect to said corner connector.

12. The prefabricated building structure of claim 1 wherein one of said vertical wall panels includes an end marginal reinforcement extending along a respective one of said end margins, said wall panel defining notch means, between said end marginal reinforcement and said bottom margin thereof, for receiving a part of said corner connector while said end marginal reinforcement extends into said corner connector.

13. The prefabricated building structure of claim 12 wherein said upright column members are of X-shaped cross section and said corner connectors are of a size to receive a respective end of an upright column member snugly therein, a pair of vertically adjacent ones of said upright column members being aligned with one another and abutting end-to-end against one another within said corner connector.

14. The prefabricated building structure of claim 12, said end marginal reinforcement fitting snugly within said laterally-open V-shaped groove of a respective one of said upright column members and a portion of said end marginal reinforcement also being located within said corner connector member together with a respective end of said respective one of said upright column members.

15. The prefabricated building structure of claim 1 wherein at least one of said wall panels and a corresponding one of said horizontal frame members include a plurality of aligned interconnecting means for fastening said wall panel to said horizontal frame member at multiple locations spaced apart therealong.

16. The prefabricated building structure of claim 15 wherein said interconnecting means comprise means defining a plurality of transverse openings in said top and bottom margins of said wall panel.

17. The structure of claim 16, said interconnecting means further including means defined in said horizontal frame member for receiving a fastener extending through one of said transverse openings in said top and bottom margins of said wall panel, and fastener means extending through said transverse opening and said means for receiving a fastener, for interconnecting said wall panel with said horizontal frame member.

18. The prefabricated building structure of claim 17 wherein said fastener means includes a pair of connector bolts and a tie plate holding said connector bolts parallel with each other spaced apart from each other by a predetermined distance.

* * * * *